US007389617B2

(12) United States Patent
Grunewald

(10) Patent No.: US 7,389,617 B2
(45) Date of Patent: Jun. 24, 2008

(54) BUILDING CURTAIN WALL SEALING SYSTEM

(75) Inventor: Fred Grunewald, Terrell, TX (US)

(73) Assignee: Oldcastle Windows, Inc., Plano, TX (US)

( * ) Notice: Subject to any disclaimer, the term of this patent is extended or adjusted under 35 U.S.C. 154(b) by 510 days.

(21) Appl. No.: 10/833,990

(22) Filed: Apr. 27, 2004

(65) Prior Publication Data

US 2005/0000181 A1 Jan. 6, 2005

Related U.S. Application Data

(60) Provisional application No. 60/466,499, filed on Apr. 29, 2003.

(51) Int. Cl.
*E04B 2/88* (2006.01)
*E04B 2/96* (2006.01)

(52) U.S. Cl. ..... 52/235; 52/733.4; 52/730.5; 52/741.4; 52/302.3

(58) Field of Classification Search ..... 52/235, 52/733.4, 741.4, 730.5, 716.2, 716.1, 717.05, 52/717.03, 57, 302.3, 302.1, 302.6
See application file for complete search history.

(56) References Cited

U.S. PATENT DOCUMENTS

| | | | | | |
|---|---|---|---|---|---|
| 334,160 | A | | 1/1886 | Berger | |
| 2,282,631 | A | * | 5/1942 | Ross | 411/516 |
| 2,703,002 | A | | 3/1955 | Suskind | |
| 2,777,405 | A | | 1/1957 | Ager | |
| 2,810,173 | A | * | 10/1957 | Bearden | 108/33 |
| 3,147,518 | A | * | 9/1964 | Horgan, Jr. | 52/476 |
| D199,828 | S | * | 12/1964 | Regan | D19/88 |
| 3,266,210 | A | * | 8/1966 | Abraham | 52/690 |
| 3,293,813 | A | * | 12/1966 | Emmons et al. | 52/238.1 |
| 3,522,684 | A | * | 8/1970 | Grossman | 52/393 |
| D223,640 | S | * | 5/1972 | Kemp | D19/65 |
| D229,757 | S | * | 1/1974 | Hansen | D14/254 |
| D241,312 | S | * | 9/1976 | McLintock | D20/43 |
| 4,006,573 | A | | 2/1977 | Biebuyck | |
| 4,050,201 | A | | 9/1977 | Hubbard et al. | |
| 4,075,800 | A | | 2/1978 | Molick | |
| 4,101,233 | A | * | 7/1978 | McConnell | 403/397 |
| D250,189 | S | * | 11/1978 | Hansen | D14/254 |
| 4,214,405 | A | | 7/1980 | Chupik | |
| 4,276,729 | A | * | 7/1981 | Shiga et al. | 52/209 |
| 4,307,551 | A | | 12/1981 | Crandell | |
| 4,307,976 | A | * | 12/1981 | Butler | 405/118 |
| 4,310,995 | A | | 1/1982 | Hanna | |
| 4,364,209 | A | | 12/1982 | Gebhard | |
| 4,370,827 | A | | 2/1983 | Furuminato | |

(Continued)

FOREIGN PATENT DOCUMENTS

| | | | |
|---|---|---|---|
| JP | 3-13644 | * | 1/1991 |

(Continued)

*Primary Examiner*—Phi D A
(74) *Attorney, Agent, or Firm*—Winstead PC

(57) ABSTRACT

Disclosed is a bridging member, formed of flexible or non-flexible material, for use with a curtain wall system for building exteriors. The curtain wall system includes a vertical mullion operable to attach to a horizontal member. A sealing member is secured in a void created by the intersection of the vertical mullion and the horizontal member. The sealing member includes a substantially planar top surface and a lip portion extending from a bottom surface of the sealing member.

13 Claims, 6 Drawing Sheets

U.S. PATENT DOCUMENTS 4,387,542 A 6/1983 Wehr
4,488,378 A 12/1984 Symon
4,519,173 A 5/1985 Roberts
4,545,161 A 10/1985 Baumann
4,573,287 A 3/1986 Hagemeyer
4,584,804 A * 4/1986 Tajima ..... 52/235
4,611,447 A 9/1986 Krechel
4,614,069 A 9/1986 Tanikawa
4,619,092 A 10/1986 Kaminaga
4,627,201 A 12/1986 Hamamoto
4,633,631 A 1/1987 Crandell
4,644,717 A 2/1987 Biebuyck
4,662,136 A 5/1987 Tanikawa
4,662,145 A 5/1987 Tanikawa
4,680,902 A 7/1987 Stefnik
4,685,263 A 8/1987 Ting
D293,885 S * 1/1988 Carlmark ..... D8/395
4,720,876 A 1/1988 Tomei
4,724,637 A 2/1988 Evans
4,773,193 A 9/1988 Biebuyck
4,783,941 A 11/1988 Loper
4,799,344 A 1/1989 Francis
4,803,820 A 2/1989 Metrick
4,817,351 A 4/1989 Michlovic
4,841,700 A 6/1989 Matthews
4,866,896 A 9/1989 Shreiner
4,873,806 A 10/1989 Jeschke
4,899,508 A 2/1990 Biebuyck
D310,847 S * 9/1990 Dietz ..... D19/90
4,956,948 A 9/1990 Hart
4,956,954 A 9/1990 Horgan
4,979,344 A * 12/1990 Kusunoki ..... 52/235
4,984,400 A 1/1991 Bockmiller
4,996,809 A 3/1991 Beard
5,036,637 A 8/1991 Biebuyck
5,058,344 A 10/1991 Biebuyck
5,065,557 A 11/1991 Laplante
5,077,947 A 1/1992 Takeda
5,185,979 A 2/1993 Azzimonti
5,252,154 A 10/1993 Hoffman
5,253,459 A 10/1993 Parinas
D347,857 S * 6/1994 Coe ..... D19/65
5,319,882 A 6/1994 Biebuyck
5,333,428 A 8/1994 Taylor
5,354,410 A 10/1994 Cohen
D363,453 S * 10/1995 Herdt ..... D11/78.1
5,469,665 A 11/1995 Biebuyck
5,546,713 A 8/1996 Voegele
5,560,149 A 10/1996 Lafevre
5,592,795 A 1/1997 Rinehart
5,596,851 A 1/1997 Ting
D378,219 S * 2/1997 Marshlack ..... D19/65
5,644,875 A * 7/1997 Nielsen ..... 52/204.591
D393,813 S * 4/1998 Herdt ..... D11/78.1
5,746,032 A 5/1998 Koike
5,749,175 A 5/1998 Koike
5,771,652 A * 6/1998 Nagata et al. ..... 52/716.5
5,839,236 A * 11/1998 Frey ..... 52/235
5,875,602 A * 3/1999 Lappin et al. ..... 52/712
5,893,244 A * 4/1999 Magoon ..... 52/235
5,930,955 A 8/1999 Biebuyck
5,937,597 A 8/1999 Sono
5,950,370 A * 9/1999 Peck ..... 52/35
6,158,182 A 12/2000 Biebuyck
6,226,940 B1 5/2001 Biebuyck
6,581,342 B1 6/2003 Tavivian
6,715,248 B2 4/2004 Biebuyck
6,993,873 B2 * 2/2006 Biebuyck et al. ..... 52/235
2005/0138875 A1 6/2005 Grunewald et al.
2005/0138889 A1 6/2005 Biebuyck
2006/0080917 A1 4/2006 Hall et al.

FOREIGN PATENT DOCUMENTS

JP 6-65977 * 3/1994
JP 6-158762 * 6/1994
JP 6-322866 * 11/1994

* cited by examiner

BUILDING CURTAIN WALL SEALING SYSTEM

CROSS-REFERENCE TO RELATED APPLICATIONS

This Application claims priority from, and incorporates by reference for any purpose the entire disclosure of, U.S. Provisional Application Ser. No. 60/466,499 filed Apr. 29, 2003.

BACKGROUND OF THE INVENTION

1. Field of the Invention

The present invention relates to building curtain walls and, more particularly, but not by way of limitation, to methods of and apparatus for constructing, assembling and sealing vertical mullions and horizontal members sections of such curtain walls along with the curtain wall panels associated therewith.

2. Description of the Related Art

The advantages of building curtain wall technology are well known and accepted in the industry. Curtain walls are typically constructed of extruded aluminum frame support members having generally U-shaped channels (although other shapes may apply) for supporting a plurality of panel members that serve as the exterior of a building. Such panel members are most often panes of glass, and often double pane glass sections, but other paneled building materials such as aluminum, granite, slate, or concrete are also utilized. Such panel members are often of identical size and shape. However, near doors, opening windows, or other access points into the building, panel members of different sizes and shapes may be utilized.

More specifically, such curtain walls generally include a horizontal member having at least one portion forming an upwardly facing region (or channel) at the bottom of a wall section, a horizontal head member having a downwardly facing channel at the top of a wall section, and a plurality of vertical members running between the horizontal member and head members. Panel members are supported by the channels of the horizontal member and the head member, and the vertical joints between adjacent panel members are formed at the members. In some designs, the mullions are disposed interiorly of the horizontal member, the head member, and the panel members so that only the joint between adjacent panel members, and not the mullions themselves, are visible from the exterior of the building. The designs do, however, vary, depending upon the desired aesthetics of the curtain wall construction.

One such design is set forth and shown in U.S. Pat. No. 4,899,508, assigned to the assignee of the present invention. The '508 patent describes a building system integrating the combination of aluminum and steel structural elements for the efficient assembly of stone and glass panels in a curtain wall system. A plurality of discrete steel clips are utilized for securing stone panels to supporting mullions. A plurality of aluminum members are secured to structural mullions whereby glass may be mounted thereto. The stone and glass panels are sealably secured adjacent one another while a glazing adapter is constructed for assembly over the structural mullions therebehind. A splice facilitates mating engagement of the aluminum mullions to permit relative movement therebetween.

Another curtain wall construction is set forth and shown in U.S. Pat. No. 6,158,182, also assigned to the assignee of the present invention. As set forth in the '182 patent, multiple panel members are typically arranged side-by-side and are secured and sealed between a horizontal member and a head member, with their vertical joints overlapping at a mullion. This vertical joint is sealed from both the interior and exterior of the building using both resilient gaskets, sealing tapes, sealant, and/or structural silicone, as described for reference purposes below.

Referring now to FIG. 1, a schematic, cross-sectional view of a horizontal member 10 of an exemplary curtain wall is shown. The horizontal member 10 secures a curtain wall to a structural support surface such as a concrete slab 12. The concrete slab 12 may be at ground level or comprising a floor surface of a high rise building, or in some embodiments, positioned behind the curtain wall. In such designs, the sill may simply be a horizontal member secured to the vertical mullion. Although not shown in FIG. 1, a head member similar to the horizontal member 10 secures the curtain wall to a concrete slab between floors of a building or other building structures, and a plurality of mullions span between the horizontal member 10 and the head member. The horizontal member 10 is typically formed as an integral aluminum extrusion. The horizontal member 10 also generally includes a channel section 14, an anchoring section 16 disposed interiorly of a channel section 14, and a cover 18.

Still referring to FIG. 1, the channel section 14 and the cover 18 cooperate to secure the panel member 20 to the horizontal member 10. More specifically, the channel section 14 includes a base 14*a* and two legs 14*b* and 14*c* that form a upwardly facing U-shaped channel. A support member 22 rests on the top surface of the base 14*a*. The exterior leg 14*b* has a groove 24 proximate the upper end of its interior surface facing the panel member 20, and the interior leg 14*c* has a support surface 26 proximate the upper end of its interior surface. The cover 18 has a downward projecting leg 28 that engages a groove 30 on the exterior surface of the interior leg 14*c*. The cover 18 also has two tongues 32, 49, one proximate to each end of the cover 18. The panel member 20 is placed within the channel section 14 on an upper surface of a setting block 34. An exterior and interior gasket 36, 38 are located at the upper end of the exterior and interior legs 14*b*, 14*c*. The gaskets 36, 38 operate to hold the panel member 20 in the channel section 14. The setting block 34 is disposed on the top surface of the support member 22. The exterior gasket 36 has a tongue 36*a* that engages the groove 24 of the exterior leg 14*b*. The exterior gasket 36 is typically pre-installed in groove 24 of the exterior leg 14*b* during the manufacture or assembly of the horizontal member 10. The interior gasket 38 has a groove 38*a* that engages the tongue 32 of the cover 18 and the support surface 26 of the interior leg 14*c*. The channel section 14 further includes a plurality of support legs 40 below base 14*a*.

The anchoring section 16 includes a base 16*a*, an interior leg 16*b*, and a plurality of support legs 42 below the base 16*a*. The base 16*a* has a plurality of holes 44 spaced along its length for receiving fasteners 46 to secure the horizontal member 10 to the structural support surface 12. The interior leg 16*b* has a groove 48 for receiving the tongue 49 of the cover 18. The cover 18 stabilizes the interior gasket 38 that presses against the panel member 20 and also conceals the base 16*a* of the anchoring section 16 so that the fasteners 46 are not visible.

The following technique is typically used to install the panel member 20 of such a curtain wall and is set forth herein for reference purposes. The horizontal member 10 is laid on a shim 56 in the proper position on the concrete slab 12 and is used as a template to drill holes into the concrete slab 12 for each fastener 46. One should note that the shim 56 does not run continuously along the length of the horizontal member 10. Instead, the shim 56 is used at low points of the concrete slab 12 to level the horizontal member 10, if necessary. The horizontal member 10 is then removed from the shim 56, and a hole 50 with a larger diameter is drilled in the place of each of the holes drilled using the horizontal member 10. A structural insert 52 is secured within each of the holes 50 via epoxy or other conventional means. Each insert 52 has an internally threaded hole 54 for receiving fasteners 46. The horizontal member 10 is repositioned on the shim 56 and secured to the concrete slab 12 using fasteners 46. A sealant 58 is continuously disposed on the concrete slab 12 along both the exterior and interior sides of the shim 56. A head member similar to the horizontal member 10 is secured to part of the building structure using the above-described techniques. Vertical mullions are secured between the horizontal member 10 and the head member at appropriate intervals along the curtain wall. The vertical mullions are attached at each side to horizontal members 10. The support member 22 is disposed on the base 14*a* of the horizontal member 10, and the setting block 34 is disposed on the support member 20. The panel member 20 is then installed from the exterior of the building, typically first being tilted into the channel section of the head member, and then being dropped into the channel section 14 of the horizontal member 10. The cover 18 is installed in the horizontal member 10, and a glazing stop is installed in the head member of the curtain wall. The interior gasket 38 is disposed on the tongue 32 of the cover 18 of the horizontal member 10, and a similar gasket is disposed on the tongue of the glazing stop of the head member.

In most currently used systems, at the junction between horizontal and vertical mullions, the mullion shape often requires special sealing arrangements. For example, the generally U-shaped mullions are not mitered at the intersection of their orthogonal engagement one with the other. The extrusion shape is therefore an issue at the intersection. This is typically found in the channel area of the horizontal member where it does not meet the respective surface of the vertical mullion for sealing purposes. Certain designs therefor incorporate additional sealing members that are secured thereacross. These sealing members are often made of the same or similar material, such as aluminum, for positioning therein.

One such design of a sealing member, a joint plug 200, designed for securement in the region of the intersection of the vertical mullion 202 and the horizontal member 204 is illustrated in FIG. 2. The joint plug 200 is typically a molded or die cut part or an extruded part that is cut-to-size for a particular curtain wall assembly. The joint plug 200 is designed to precisely fit into the void at the region created between the channel 206 and the vertical mullion 202. Sealant 208 is utilized to create a permanent, water-tight seal between the joint plug 200, the vertical mullion 202, and the horizontal member 204. As shown, the insertion of the joint plug 200 creates a stepped-down cavity lower than the bottom surface of the channel 206. The joint plug 200 is a handed piece that may not be utilized in other curtain wall assemblies with intersections of the vertical mullion because the shape of the joint plug 200 is designed specifically for one type of curtain wall system. A handed piece is a non-symmetrical piece that has a specific application (i.e., a different handed piece is needed for each side of a vertical mullion). Also, the joint plug 200 may need to be installed prior to installing exterior face members.

Another such design is set forth and described in co-pending patent application Ser. No. 60/364,880 filed Mar. 13, 2002, assigned to the assignee of the present invention and incorporated herein by reference. As shown therein, the sealing member is made of aluminum. In the particular application as referenced above, incorporated herein by reference, such a metal sealing member has a particular utility that may not be required in certain curtain wall systems. For instance, some curtain wall systems may require additional structural support in the area of the intersection of the horizontal member and the vertical mullion. However, not all curtain wall systems require additional strength at the intersection. The junction between horizontal and vertical mullions does, however, typically require a bulkhead spanning the majority of the open space to provide a surface upon which a sealing compound, such as silicone, may be applied. Even the utilization of metal does not, in and of itself, typically provide a sealed surface when abutting another member. The purpose of applying sealant is typically to prevent and/or control the flow of moisture within the curtain wall systems. The use of waterproof sealant is provided to thereby create a sealed surface to therein deflect the flow of any moisture to an area of the horizontal member where discharge is permitted. Such designs facilitate the drainage of water which has infiltrated the structural members of a curtain wall system and the subject of which is addressed in a number of existing patents including U.S. Pat. Nos. 4,644,717 and 4,773,193 assigned to the Assignee of the present invention.

SUMMARY OF THE INVENTION

The present invention relates to curtain walls used for building exteriors and the assembly of a building curtain wall with sealing members facilitating the sealing between vertical and horizontal member assemblies. More particularly, one aspect of the present invention relates to a bridging member for sealing a void between a horizontal member and a vertical mullion of a curtain wall system. The sealing member includes a body surface including a mating region and an edge, the body surface having a substantially planar top surface, a lip portion for engagement with the horizontal member, the lip portion disposed on a bottom surface of said body surface. The mating region abuts the horizontal member and the edge abuts the vertical mullion.

In another aspect, the present invention relates to a curtain wall system. The curtain wall system includes a vertical mullion for attaching to a support structure of a building, a horizontal member for intersecting with the vertical mullion, and a bridging member for sealing a void between the horizontal member and the vertical mullion. The sealing member includes a body surface and a lip portion, the body surface having a substantially planar top surface and the lip portion disposed on a bottom surface of the body surface.

BRIEF DESCRIPTION OF THE DRAWINGS

For a more complete understanding of the present invention, and for further objects and advantages thereof, reference is made to the following description taken in conjunction with the accompanying drawings in which.

DETAILED DESCRIPTION OF THE INVENTION

It has been discovered that when required the sealing of voids between a vertical mullion and a horizontal member of a curtain wall system can be both time consuming and expensive, and the utilization of a bridging member, formed of flexible or non-flexible material, that may be manually installed during or after the assembly of the curtain wall sections may afford improved efficiency thereto. Since sealing of the intersection between the vertical mullion and the horizontal member is necessary for some applications in order to prevent uncontrolled water passage, the voids created by the intersection of non-planar members, such as the vertical mullion and the horizontal member of a curtain wall system, present a number of design issues. The previous utilization of rigid sealing members and/or special fabrication techniques to allow for services adapted for receding sealant therearound to effect the sealing therebetween have not been as economically efficient and/or commercially viable as necessary for current-day demands in building wall construction. The flexible sealing under some embodiments of the present invention, as described below, thus affords the designer of the curtain wall system as well as the installation team the ability to effectively provide a sealing surface in the void between the vertical mullion and the horizontal member adapted for the receipt of sealant thereupon in a manner which is much less expensive and time consuming, and manifests numerous advantages over prior systems.

Figure 1:
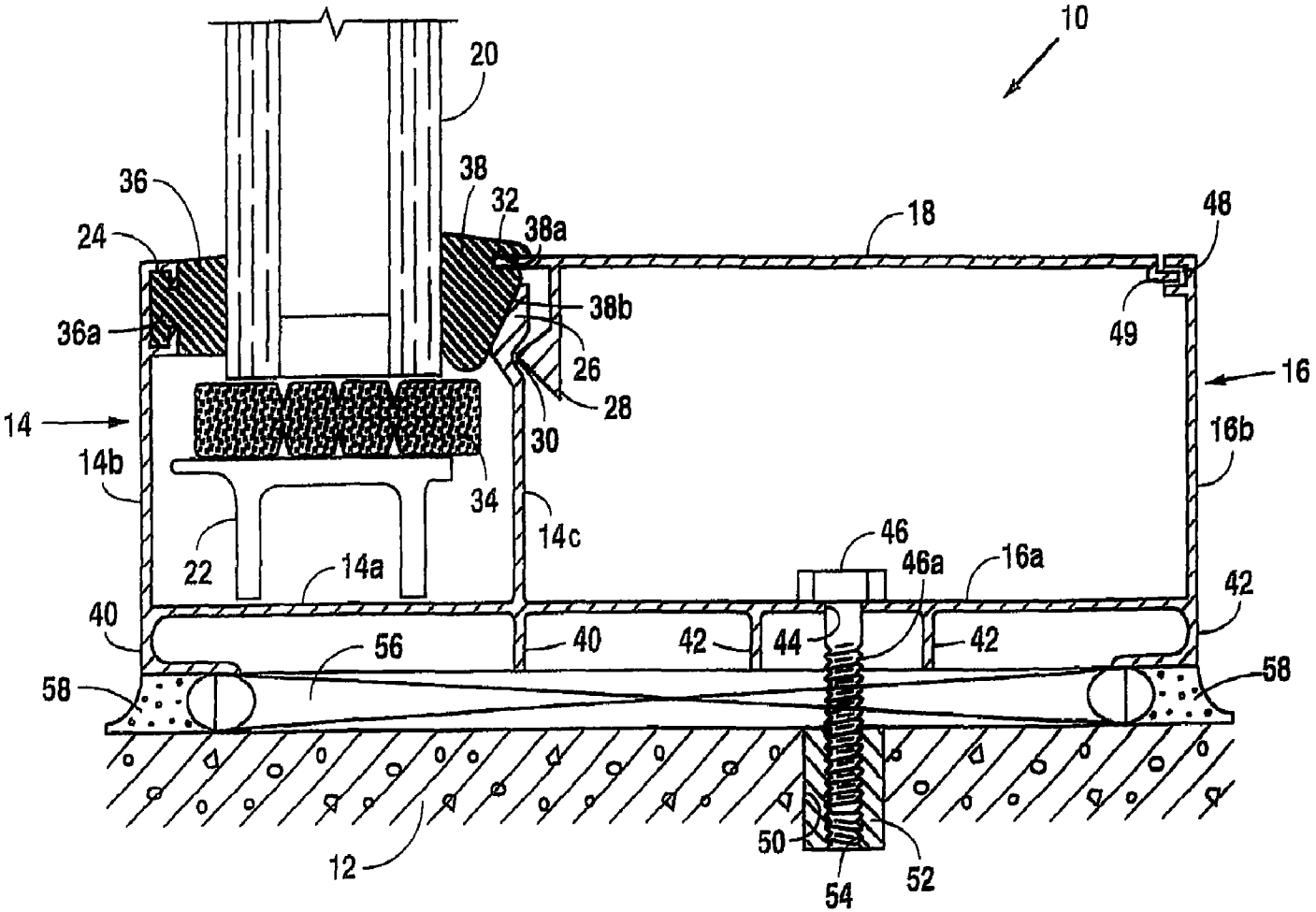
FIG. 1 (PRIOR ART)
FIG. 1 (Prior Art) is a side-elevational cross-sectional schematic view of a horizontal sill member of a conventional curtain wall.
Figure 2:
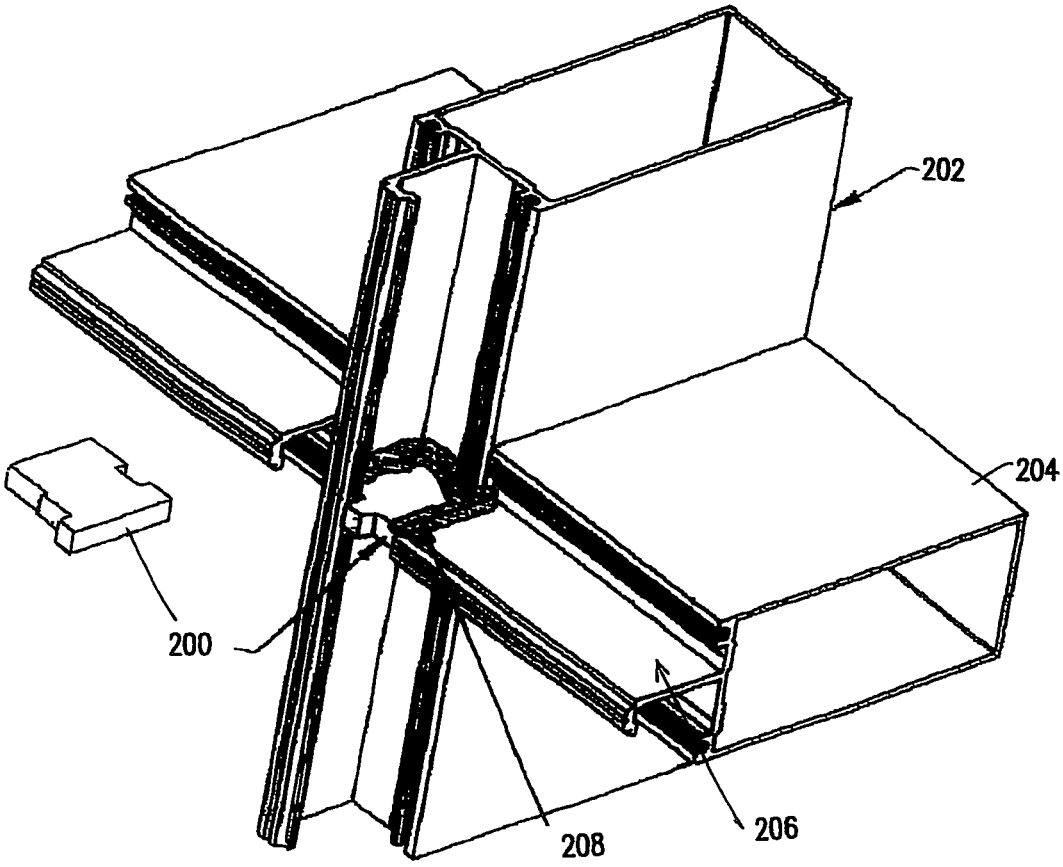
FIG. 2 (PRIOR ART)
FIG. 2 (Prior Art) is a perspective view of the intersection of the vertical mullion and horizontal member utilizing a handed joint plug.
Figure 3:
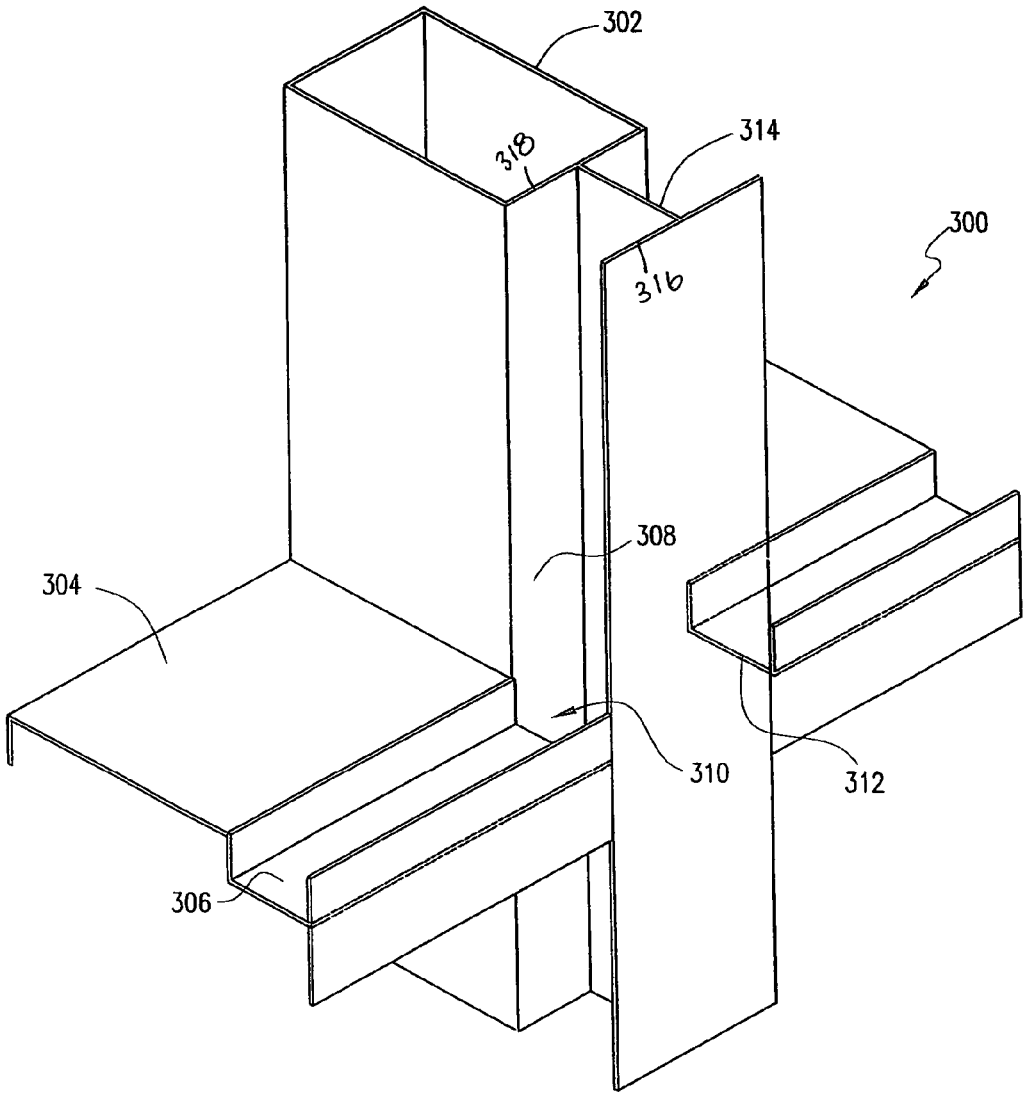
FIG. 3 is a perspective view of the intersection of the vertical mullion and horizontal member of a curtain-wall system illustrating the region requiring sealing.

Referring first to FIG. 3, a perspective view of portions of an intersection 300 of a vertical mullion 302 and a horizontal member 304 of one type of curtain wall system is illustrated. It may be seen that the horizontal member 304 intersects the vertical mullion 302 along an intersection 300. A web portion 312 of a channel 306 of the horizontal member 304 thus abuts an outer portion of the mullion channel 308 of the vertical mullion 302 forming a void 310 therebetween. The mullion channel 308 includes a support surface 314 and two side surfaces 316, 318 forming a boundary of the void 310. The void 310 must be sealed in accordance with many curtain wall assembly procedures, and the present invention addresses such methods of an apparatus for sealing such voids utilizing a bridging member adapted for receiving sealant therearound, as described in more detail below.

Figure 4:
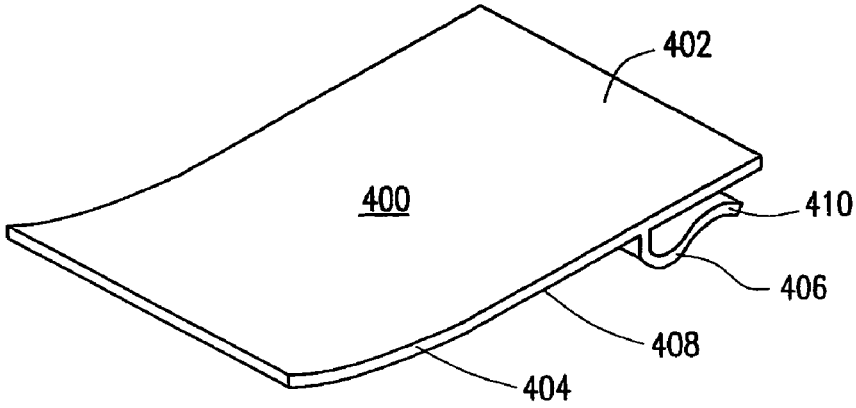
FIG. 4 is a perspective view of first embodiment of a bridging member construction in accordance with the principles of the present invention.

Referring now to FIG. 4, there is shown a perspective view of a bridging member 400 addressing a top surface 402 thereof. The bridging member 400 may be formed by molding, extruding or other means of rigid PVC or the like, and fabricated to include an enlarged body surface 404 having a connection region 406 formed thereon. In the present embodiment, the connection region 406 is formed on an underside 408 thereof, and forms a curved mouth region 410 adapted to engage the web portion 312 of the horizontal member 304 as will be described in more detail below.

Figure 5:
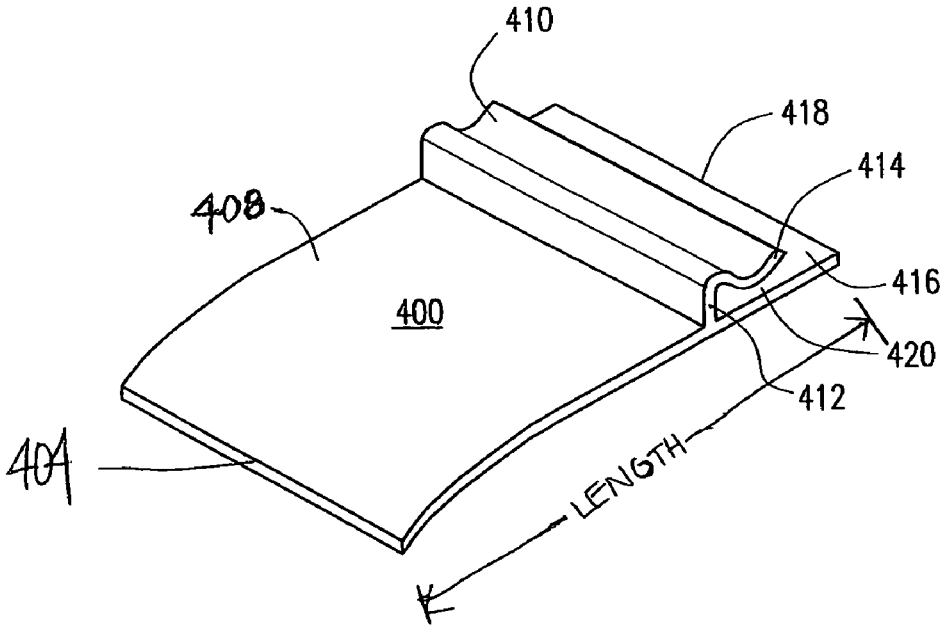
FIG. 5 is a perspective view of the underside of the bridging members of FIG. 4 illustrating certain aspects of the fabrication thereof.

Referring now to FIG. 5, there is shown a perspective view of the bridging member 400 taken from an underside thereof. The curved mouth region 410 of the bridging member 400 is shown to be formed in a first downwardly extending body portion 412 and a transversely curved lip portion 414. In some embodiments, where the bridging member 400 is formed of flexible material, such as plastic, the space between an underside surface 416 of a mating region 418 of the bridging member 400 is therefor engaging the web portion 312 of the horizontal member 304 referenced above. As mentioned above, although some embodiments illustrate a bridging member that is flexible, the bridging member may also be formed of a non-flexible material without departing from aspects of the present invention. The space between the underside surface 416 and the curved lip portion 414, said space being referred to as region 420 is preferably of a size less than the thickness of the web portion 312 of the horizontal member 304 as will be described in more detail below for purposes of creating a secure fit thereacross. The length of the body surface 404 of the bridging member 400 is likewise longer than the void 310 between the horizontal member 304 and the vertical mullion 302 as shown in FIG. 3. In some embodiments of the present invention, the increased length of the body surface 404 of the bridging member 400 allows for a bending and flexing of the bridging member 400 against the support surface 314 of the mullion channel 308 of the vertical mullion 302 to urge secure engagement between the security in region 420, and the web portion 312 of the channel 306 of the horizontal member 304, as further described below.

Figure 6:
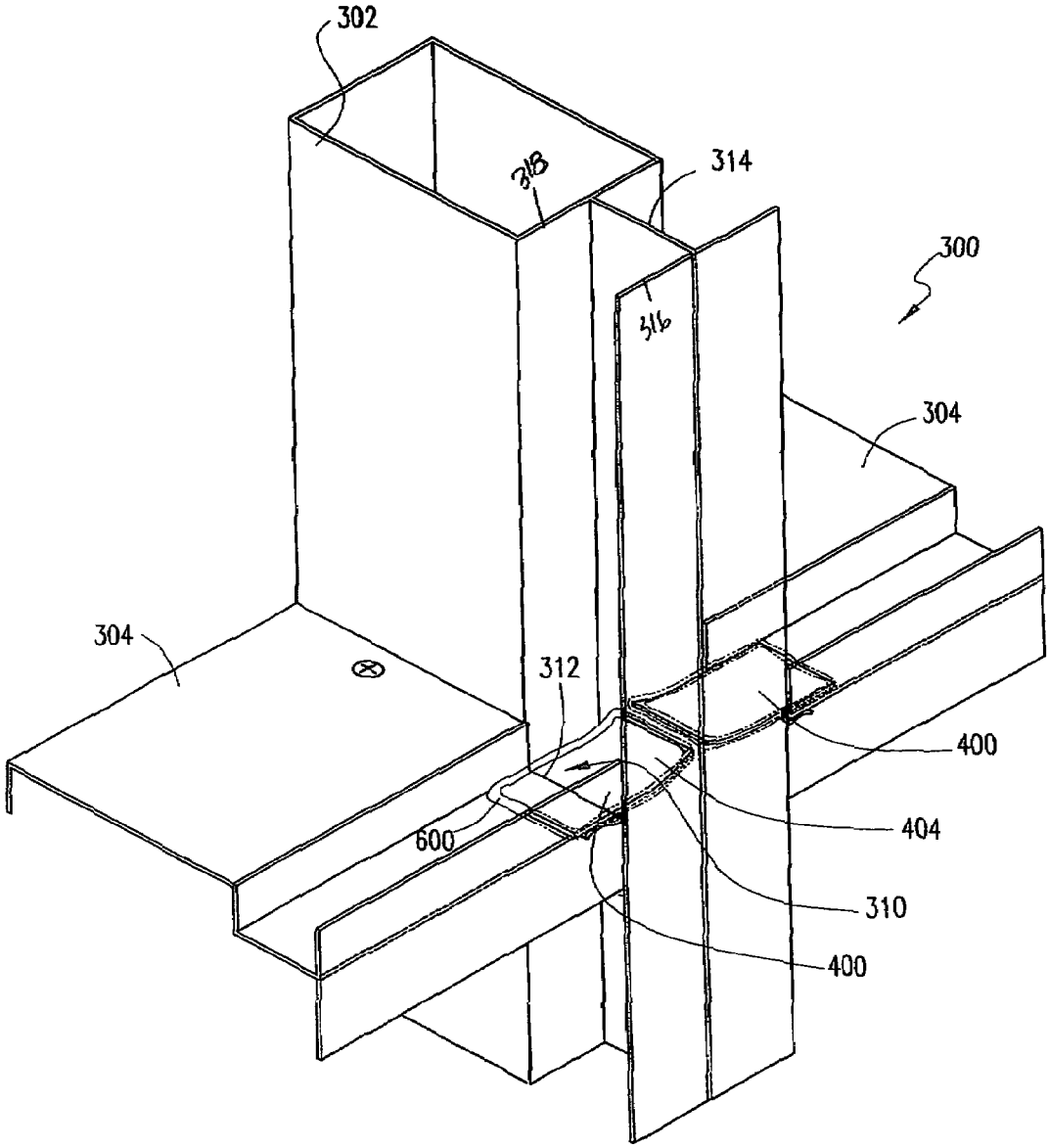
FIG. 6 is a perspective view of the vertical mullion and horizontal member intersection of FIG. 3 illustrating the placement of the bridging member depicted in FIGS. 4 and 5, and utilizing dotted lines to further illustrate the placement thereof.

Referring now to FIG. 6, there is shown the vertical mullion 302 and the horizontal member 304 intersection 300 of FIG. 3 and the void 310 therebetween filled by the bridging member 400 placed therein. A bridging member 400 may be placed on each side of the support surface 314 of the vertical mullion 302.

Still referring to FIG. 6, the bridging member 400 is placed across the void 310 providing a surface upon which a sealant 600 can be applied. The bead of sealant 600 is shown extending around the body surface 404 of the bridging member 400 to thereby provide sealing between the body surface 404, the support surface 314, and the two side surfaces 316, 318 of the vertical mullion 302 and the web portion 312 of the horizontal member 304. Likewise sealant 600 is shown to be provided around the bridging member 400 attached to a second horizontal member 304 so that the void 310 on each side of the vertical mullion 302 is sealed.

Figure 7:
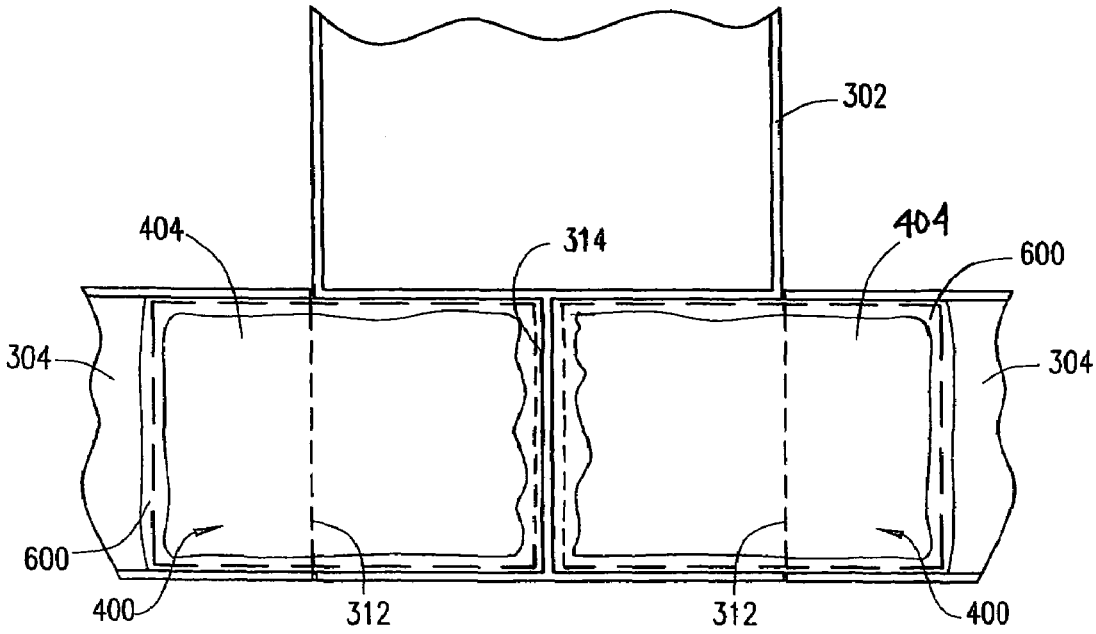
FIG. 7 is an enlarged top plan view of the horizontal member and vertical mullion intersection of FIG. 6 illustrating the position of the bridging members therein and the presence of sealant therearound.

Referring now to FIG. 7, there is shown a top plan view of the vertical mullion 302 and the bridging member 400. The top surface 402 of the bridging member 400 is shown in the top view, whereas the mating region 418 is hidden. An edge of the bridging member 400 abuts the support surface 314 of the vertical mullion 302 and the region 420 of the bridging member 400 including the mating region 418 secures to the web portion 312 of the horizontal member 304. The body surface 404 of the bridging member 400 creates a ramp angled down from the support surface 314 to the web portion 312. The sealant 600 is placed along two sides of the bridging member 400 as well as the two edges.

Figure 8:
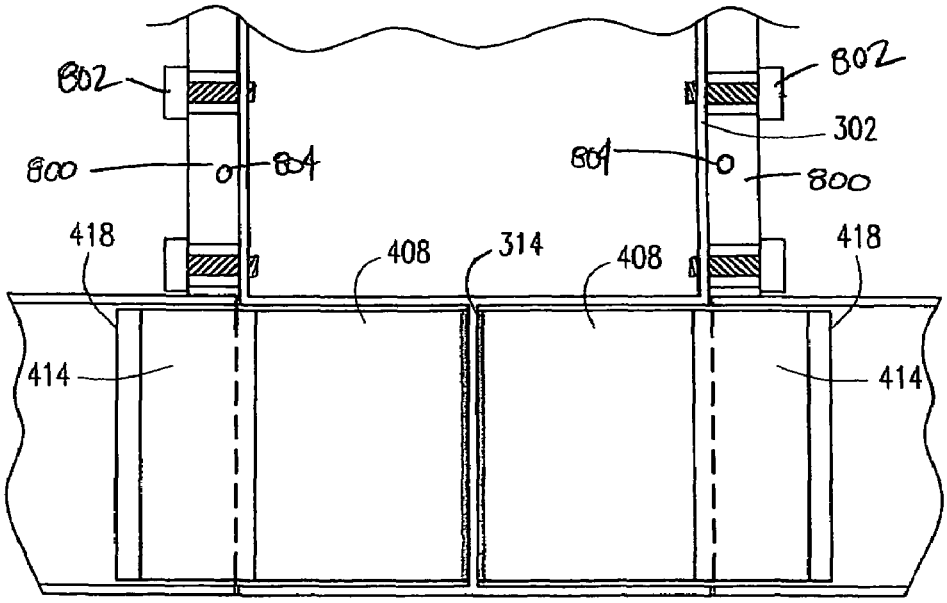
FIG. 8 is a bottom-plan view of the horizontal member and vertical mullion intersection of FIG. 7 illustrating the bridging members therein from the underside thereof.

FIG. 8 illustrates a bottom plan view of the vertical mullion 302 attachment to the horizontal member 304 and the bridging member 400. The underside 408 of the bridging member 400 is shown as well as the curved lip portion 414. While the mating region 418 engages a top surface of the web portion 312, the curved lip portion 414 engages a bottom surface of the web portion 312 so that the edge of the web portion 312 is disposed between the mating region 418 and the curved lip portion 414.

In one embodiment of the present invention, the horizontal member 304 and the vertical mullion 302 are fastened together via an attachment piece or attachment piece 800 and fasteners 802. The attachment piece 800 may be fashioned with screw splines that receive screws that penetrate the vertical mullion 302 in order to secure the horizontal member 304. One or several screw splines and screws may attach the attachment piece 800 to the vertical mullion 302. The attachment piece 800 is secured to the horizontal member via a fastener 804. Although the attachment piece 800 is shown as a single piece fashioned in a rectangular orientation including screw splines, a variety of shapes and fasteners may be utilized to secure the horizontal member 304 to the vertical mullion 302. In addition, the vertical mullion 302 and horizontal member 304 may be formed from multiple pieces.

It is thus believed that the operation and construction of the present invention will be apparent from the foregoing description. While the method and apparatus shown or described have been characterized as being preferred it will be obvious that various changes and modifications may be made therein without departing from the spirit and scope of the invention.

What is claimed is:

1. A curtain wall system comprising:

a vertical mullion for attaching to a support structure of a building;

a horizontal member for intersecting with said vertical mullion; and a unitary bridging member for completely sealing a void between said horizontal member and said vertical mullion, said bridging member including a body including a mating region and an edge, said body being substantially planar; a mouth region disposed on a bottom surface of said body, said mouth region having a body portion extending outwardly from the body and a curved lip portion extending from said body portion in a direction substantially parallel to said body; wherein said mating region abuts said horizontal member of said curtain wall system, and said edge abuts said vertical mullion of said curtain wall system; and wherein said curved lip portion engages said horizontal member of said curtain wall system in a space formed between said lip portion and said bottom surface.

2. The curtain wall system of claim 1, wherein said vertical mullion includes a support surface and said horizontal member includes a web portion, and wherein said bridging member abuts said support surface and said web portion.

3. The curtain wall system of claim 1, wherein said lip portion is disposed between said mating region and said edge of said body.

4. The curtain wall system of claim 1, wherein said body is oriented at an angle between said horizontal member and said vertical mullion.

5. The curtain wall system of claim 1, wherein said bridging member is formed of a flexible material.

6. The curtain wall system of claim 1, wherein said bridging member is molded.

7. The curtain wall system of claim 1, wherein said bridging member is extruded and cut to size.

8. The curtain wall system of claim 1, wherein said vertical mullion and said horizontal member are formed of aluminum.

9. The curtain wall system of claim 1, wherein said vertical mullion is formed as a single extrusion.

10. The curtain wall system of claim 1, wherein said horizontal member is formed as a single extrusion.

11. The curtain wall system of claim 1, wherein said vertical mullion is formed from multiple extrusions.

12. The curtain wall system of claim 1, wherein said horizontal member is formed from multiple extrusions.

13. The curtain wall system of claim 1, wherein the bridging member is formed of non-flexible material.

* * * * *